US006014784A

United States Patent [19]

Taylor et al.

[11] Patent Number: 6,014,784

[45] Date of Patent: Jan. 18, 2000

[54] PORTABLE SYSTEM FOR GENERATING VARIABLE PRESSURE POINT BODY SUPPORT

[76] Inventors: Rex E. Taylor, 439 W. F St., Dixon, Calif. 95620-2802; Thomas W. Christopherson, 451 Bellwood Dr., Santa Clara, Calif. 95054

[21] Appl. No.: 09/175,103

[22] Filed: Oct. 19, 1998

[51] Int. Cl.[7] ..... A61G 7/04

[52] U.S. Cl. ..... 5/713; 5/710; 5/706; 5/655.3; 297/284.6

[58] Field of Search ..... 5/713, 706, 715, 5/655.3, 654, 710; 297/284.6, 452.41, DIG. 3

[56] References Cited

U.S. PATENT DOCUMENTS

| | | | |
|---|---|---|---|
| 5,020,176 | 6/1991 | Dotson | 5/710 |
| 5,303,977 | 4/1994 | Sereboff | 297/284.6 X |
| 5,542,136 | 8/1996 | Tappel | 5/710 |
| 5,611,096 | 3/1997 | Bartlett et al. | 5/710 X |
| 5,687,438 | 11/1997 | Biggie et al. | 5/713 X |
| 5,926,884 | 7/1999 | Biggie et al. | 5/713 X |

*Primary Examiner*—Terry Lee Melius
*Assistant Examiner*—Fredrick Conley
*Attorney, Agent, or Firm*—Monty Koslover

[57] ABSTRACT

A system supporting a cushion, containing a plurality of covered inflatable air bladders and the controls and means for inflating the bladders. Bladders may be arranged in two or more arrays and controlled so that each array is inflated and deflated at different times than are other arrays. This provides continuously variable pressure points for a cushion which supports a person. A re-programable microprocessor controls the sequence and timing of array inflation which can be selected to suit individual needs. An included rechargeable battery provides power for at least 16 hours operation and enables easy system portability. The system may be used in cushioning for wheelchairs, and for many other seating and support applications, including support for animals. It includes a remote control/alarm panel with an on/off switch and audio/visual alarms warning of power or other system failure. The system is simply constructed using mostly n0n-specialized components and materials, and is therefore relatively inexpensive.

12 Claims, 7 Drawing Sheets

PORTABLE SYSTEM FOR GENERATING VARIABLE PRESSURE POINT BODY SUPPORT

BACKGROUND OF THE INVENTION

1. Field of the Invention

This invention relates to systems providing cushioned body support for people, and more particularly, to a system generating variable pressure point body support.

2. Background

There has long been a widely recognized need for a means of relieving the discomfort of people who have to remain seated for long periods of time. This particularly has urgency for elderly or sick people who are seated on wheelchairs because of the possible development of ulcers on their buttocks due to the pressure generated by remaining in one position.

The need has been addressed by a number of inventors and manufacturers who have produced cushions containing devices that vary the cushion support points, thus shifting the areas of pressure on a person's body. An example is U.S. Pat. No. 5,487,197 by Iskra, Jr. et al. which describes a pneumatic wheelchair cushion having ajoining pneumatic chambers that are sized and shaped for cushioning a user's coccyx, ischial tuberosities, greater trochanters and thighs. The pressure in the pneumatic chambers is controlled and varied by an included controller. Another example is U.S. Pat. No. 3,867,732 by Morrell which describes a cushion having a foam rubber body which supports a number of inflatable tubes in transverse side-by-side relation. The tubes are connected to an air supply that provides inflation air pressure, and is controlled by means to inflate and deflate alternate tubes so as to vary the points of support for a person using the seat. In this invention, the person sits directly on the tubes, with the cushion being under the tubes. There are many other inflatable cushions offered for use that include rows of tubes that are alternately inflated or pulsed. Some of these are described in U.S. Pat. Nos. 2,719,986, 3,008,465, 3,148,391 and 3,678,520.

Few of these available, patented cushion assemblies have actually been sold to the public. Among other reasons, this rejection is due to perceived lack of needed portability, lack of easy adaptibility to particular needs, and the prohibitive cost of the devices offered. The high cost of these specialized devices is a particular deterrent for elderly persons who are by far the greatest number of wheelchair users.

Other situations where a variable pressure cushioning device is needed and would be much appreciated include a seat and back support for long-haul truck drivers, a seat support for office clerical workers, and back and leg support for prone patients lying in bed. Except for long-haul truck drivers, none of the above described and available cushion devices appear to be easily adapted or suitable to alleviate the foregoing seating and support needs. The matter of high cost could also discourage their use.

A variable pressure cushioning device is also needed for supporting sick or elderly animals for the same reasons as for humans. For many pet owners, this is a serious need that has not been addressed, to our knowledge.

There is therefore a need for a system which generates variable pressure point body support, cushioning a seated or prone person, which is portable, adaptable to individual needs and is relatively low in cost. There is also a need for such a system in cushioning sick or elderly animals, particularly pets.

SUMMARY OF THE INVENTION

A system is described that contains a plurality of covered inflatable air bladders and the controls and means used to inflate the bladders. The bladders may be arranged in two or more arrays, and are controlled so that bladder inflation and deflation times in any cycle differ for each array, thus generating continuously variable pressure points for the cushion on which a person sits or is otherwise supported. An externally programmable microprocessor provides control of any sequence of array inflation, including cycling times and bladder inflation amplitude selected to suit individual needs. A rechargeable battery power source and a battery charger circuit are included to provide system portability. The system may be used and incorporated in cushioning for wheelchairs, back and seat support cushioning for truck drivers, cushioning for bed-ridden individuals and other applications, including cushioning for sick animals. The system includes a remote control/alarm panel having a system on/off switch and audio/visual alarms warnings of power or other system failure. The system is simply constructed using mostly non-specialized components and materials, and is therefore relatively inexpensive.

Accordingly, it is a principal object of this invention to provide a portable system that will constantly change the pressure points under a seated or otherwise supported person, according to a pre-selected timing and sequence.

Another object is to provide a portable continually massaging system that can be used on all parts of the body.

Yet another object is to provide a relatively inexpensive system that will constantly change the pressure points under a person who has to sit in a wheelchair for long periods of time.

A great advantage of the invention over existing systems is the ability to pre-program the sequence and timing of the applied pressure point variations to fit individual requirements. Another advantage of the invention over existing systems is its easy portability.

Further objects and advantages of the invention will be apparent from studying the following portion of the specification, the claims anid the attached drawings.

DESCRIPTION OF THE PREFERRED EMBODIMENT

Figure 1:
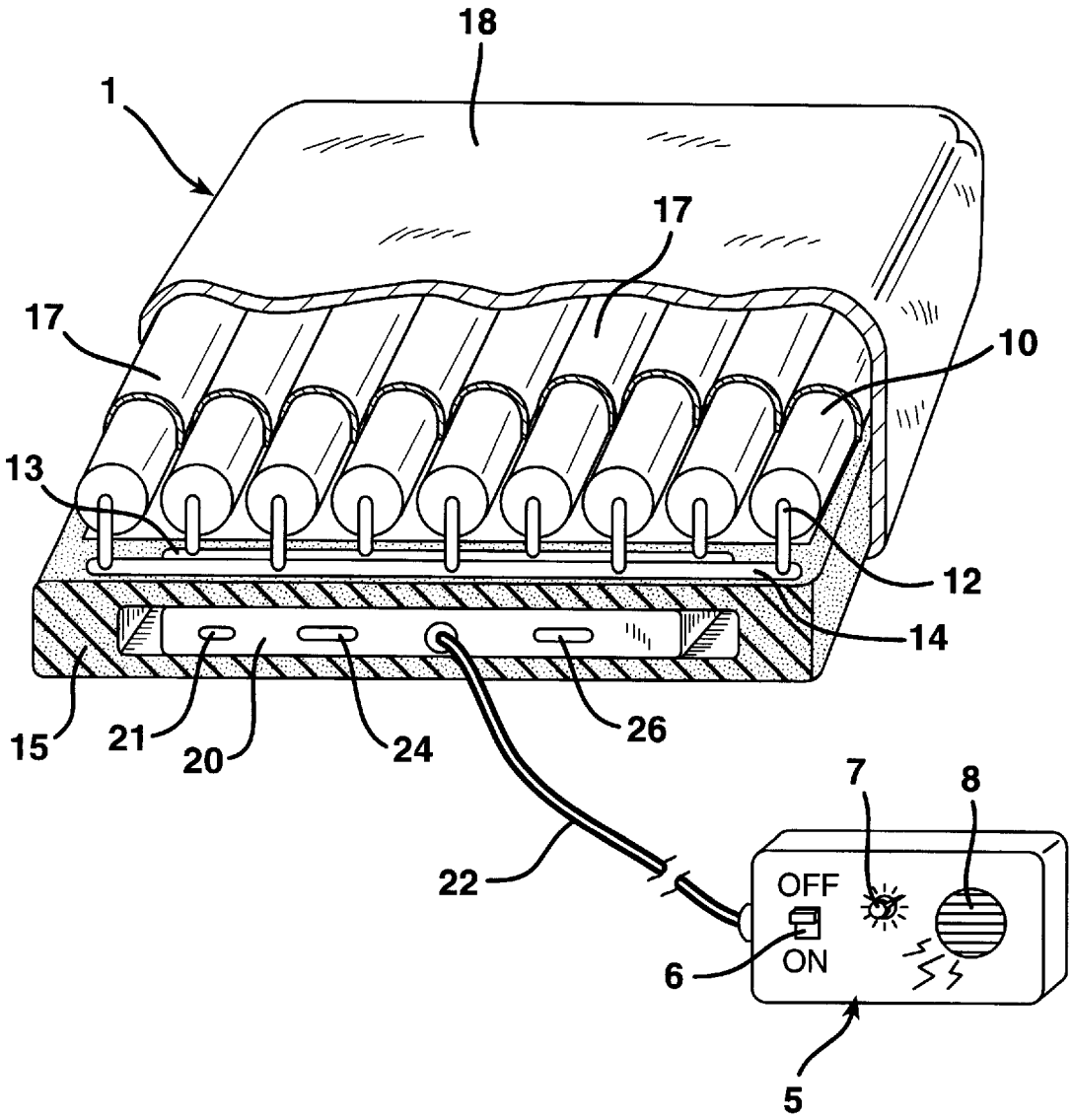
FIG. 1 is a perspective view of a cushion which is partly cut away to show an incorporated embodiment of the invention system for generating variable pressure point body support.

Referring particularly to the drawings, there is shown in FIG.1 a perspective view of a cushion 1 that incorporates an embodiment of the invention system for generating variable pressure point body support. The cushion 1 shown is not part of the invention, but rather a means of containing the invention and transmitting the system generated pressure through the cushion as support for a body.

The system configuratior illustrated in FIG. 1 relates particularly to a flat seat cushion for use in a wheelchair for invalided patients, or for a long-haul truck driver. In both cases, there is a need for constantly varying the pressure to areas supporting different locations on the buttocks of a seated person. This is performed by the invention system which applies variable pressure through a cushion top 18.

The cushion 1 is cut away to show major system elements. These are: two arrays of inflatable air bladders 10 in this configuration, cloth covers 17 for each individual bladder 10, two air manifolds 13, 14, one connected to each array of bladders 10, a rigid support member base 15 on which the arrays of bladders are placed, a control/activation module 20, and a remote switch and alarm panel 5 which is connected 22 to the control/activation, module 20.

Each air manifold 13, 14, is connected by tubes to an inlet 12 at one end of each bladder 10. Both manifolds are then separately connected to the control/activation module 20. The arrays of inflatable bladders are arranged in rows so that the bladders of one array alternate in position with the bladders of the other array. Thus, looking at the front line-up of bladders in FIG. 1, the first, third, fifth and etc. would be part of array "A" while the second, fourth, sixth and etc are part of array "B". This arrangement results in bladder inflation differences between each array being expressed as pressure points varying from one bladder to the next one beside it.

It should be understood that the system is not limited to only two arrays of inflatable bladders. More than two arrays could be used if need be. Similarly, there is no fixed number of inflatable bladders in an array. This can be any convenient number, depending on the system size and application. When more than two arrays of bladders are used, the number of connecting air manifolds would be increased accordingly.

On one side of the control/activation module 20 there are located three connectors. These connectors are for connecting to a programming input 21, dc input power 24 and a battery charging source 26. The programming input 21 is used for programming a microprocessor in the controls, and may be performed at the factory or using supplied equipment at a user application site. By programming the microprocessor, the system may be made to amply air pressure in any sequence to the bladder arrays, and in any timing and amplitude in order to fit the particular needs of a user.

The do input power connection 24 is used in those applications where it is desired to use a wired, external power source. A small, low voltage dc converter could be used to convert outlet ac 110 v power to the required low voltage dc level. Low dc voltage and current is used for safety purposes.

A rechargeable battery that could continually operate for 16 hours or more, normally powers the system and is contained in the control/activation module 20. The battery will require recharging when discharged, and this is periodically done by connecting the charging connector 26 to a battery charging source that charges according to a pre-established method and schedule.

A remote control panel 5, which is depicted in FIG. 1 and is connected 22 to the control/activation module 20, contains a system on/off power switch 6, an alarm light 7 that will flash red in the event of system failure, and an audio alarm 8 to announce a system shutdown caused by a system failure. The panel 5 may be mounted attached to the arm-rests of a wheel-chair and is designed particularly with the needs of wheel-chair confined elderly patients in mind. The alarms alert an attendant that perhaps the battery has discharged and needs to be recharged, or that some other action needs to be taken. These alarms would also be useful for non-wheel-chair users of the invention to warn them of corrective action to be taken.

As shown in FIG. 1, the rigid support member 15 is preferably made of a foamed plastic material and includes a cavity to enclose the control/activation module 20. In addition to supporting the bladder arrays and the cushion, the support member 15 serves to electrically and thermally insulate the user above from the system control/activation module 20. There is relatively little heat generated by the module 20, but even this small amount of heat must be externally dissipated to maintain reliable operation. Convection cooling of the nodule 20 is achieved by using holes in the sides of the support member 15 by which the electrical connectors are brought out, together with a few cross-direction holes. This ensures that the module will not overheat.

The system application illustrated in FIG. 1, a chair seat cushion, is only one of many that could incorporate the invention system described herein. However, the particular system configuration shown here facilitates understanding of the system and therefore, is used to form the basis of the following detailed system description.

Figure 2:
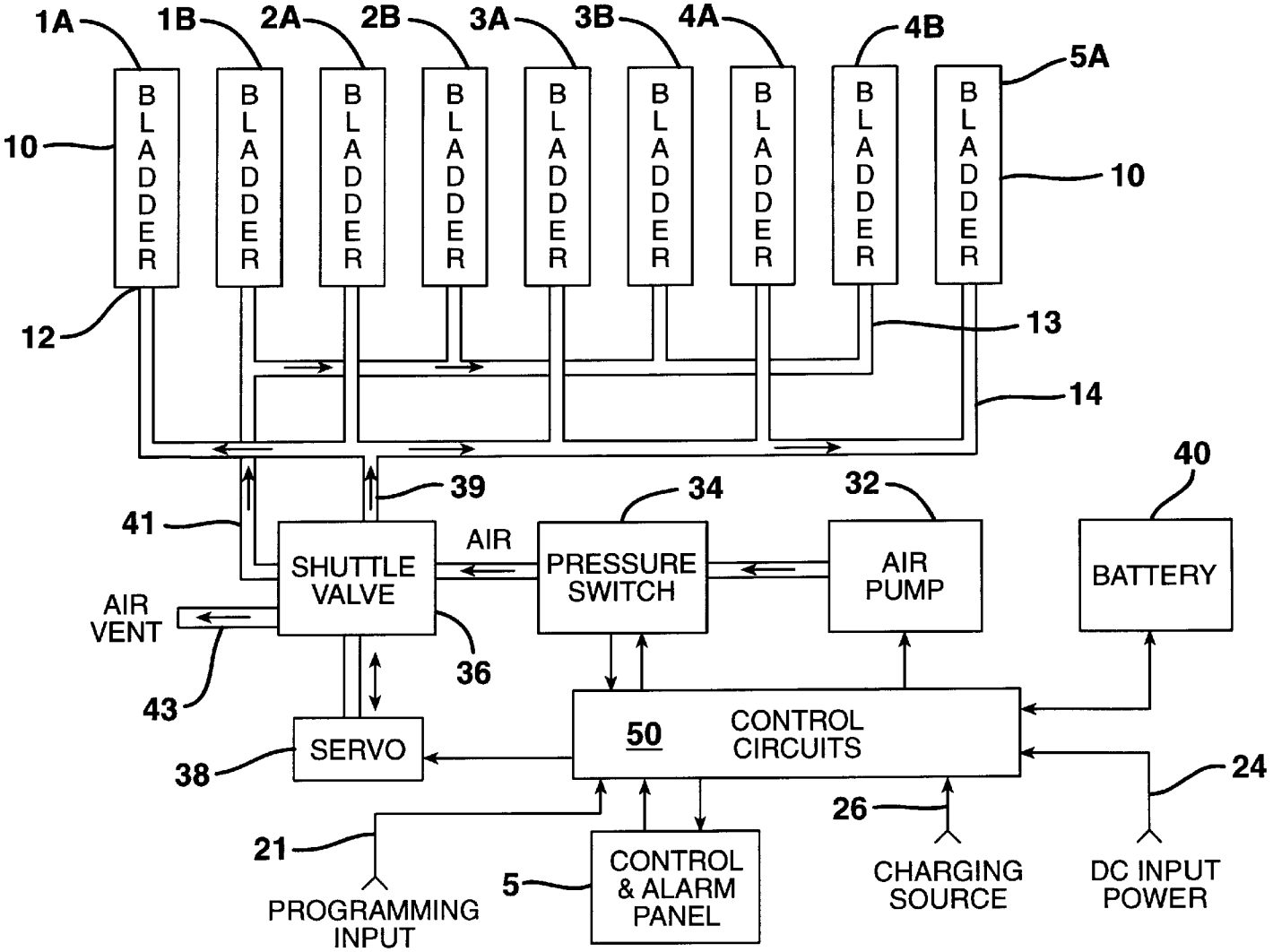
FIG. 2 is a simplified block diagram of the system according to the present invention.

Refer now to FIG. 2 which is a simplified block diagram of a system for generating variable pressure projections for body support according to the present invention, using only two bladder arrays.

The two bladder arrays are designated as "A" and "B" for the purpose of discussion only. Thus the bladders 10 in array A are referenced as 1A, 2A, 3A, 4A and 5A etc., while the bladders in array B are referenced as 1B, 2B, 3B, and 4B etc. Any multiple quantity of inflatable bladders 10 may be used in a given array, limited only by the system application requirement. A small number of bladders are shown here for the sake of simplicity.

The bladder arrays A and B are shown with B array bladders alternating in position with A array bladders, and each array is connected to a separate air manifold 13, 14, by tubes that are connected to the inlets 12 of each bladder.

Contained inside the control/activation module 20 are the following components and assemblies: a rechargeable battery 40, an air pump 32, an air pressure switch 34, a shuttle valve 36, a servo-mechanism 38 and control circuits 50.

The battery 40 consists of rechargeable battery cells having an amp-hour capacity sufficient to operate the system for at least 16 hours before recharging. The battery 40 is connected to the control circuits 50 and thereby to all electrical circuits in the system requiring power.

The air pump 32 and the air pressure switch 34 connected to the pump, combine to supply regulated, pressured air to the air manifolds 13, 14, when so commanded by the control circuits 50. The control circuits 50 send signals to a servo-mechanism 38, which mechanically operates the shuttle valve 36 to direct pressured air input from the pressure switch 34 to either one manifold connection 39 or the other 41. The shuttle valve 36 also includes means to mechanically vent air through an outlet 13, from either one of the air manifolds on command by the control circuits 50.

In addition to all the aforementioned components, the control circuits 50 also interface with the following: a control/alarm panel 5 for remotely switching power on or off and alarms; a microprocessor programming input connection 21; a battery charging source connector 26, and with a connector for a dc input power source 24 that supplies power as an alternate to the battery 40.

Figure 3:
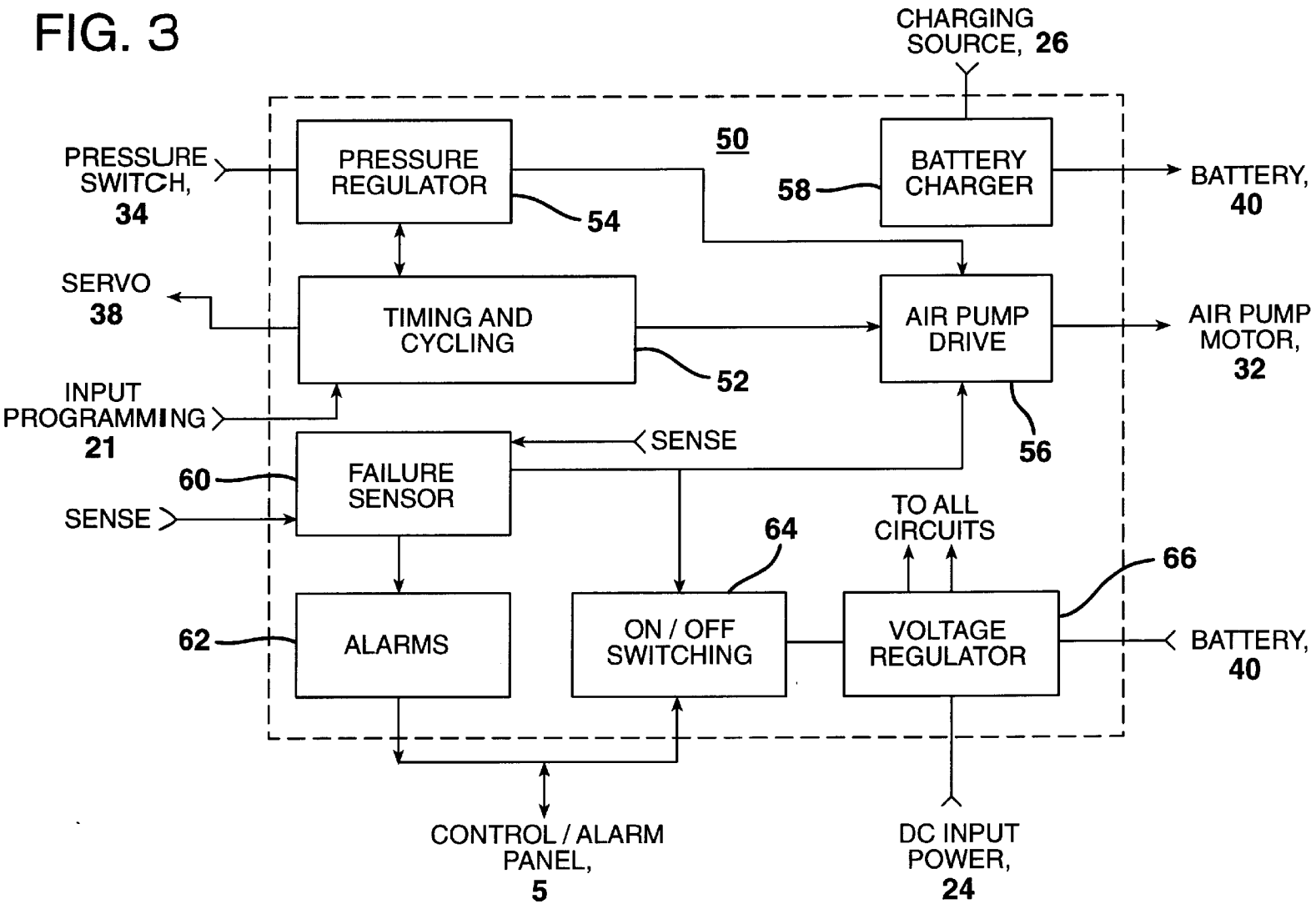
FIG. 3 is a simplified block diagram showing the relationships of the control circuits forming part of the system block diagram in FIG. 2.
Figure 3A:
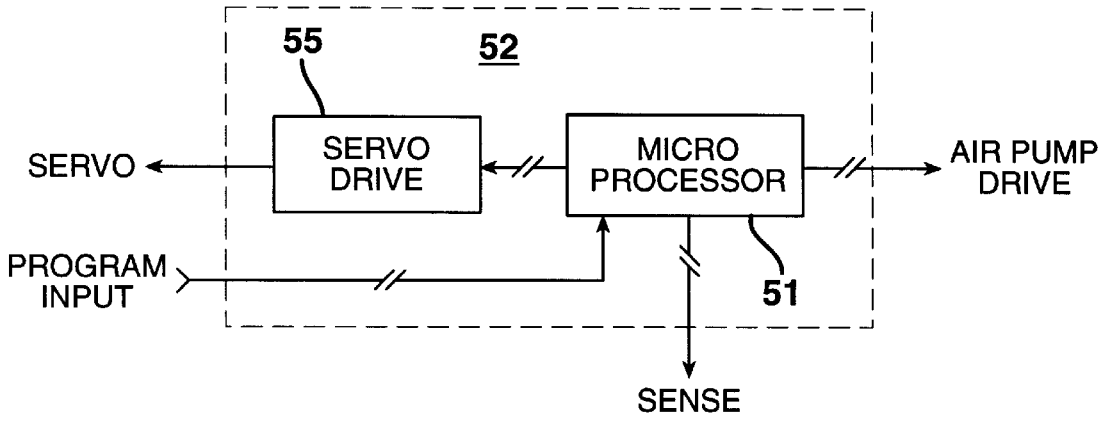
FIGS. 3*a* and 3*b* are alternative block diagrams of the circuit functions contained in the timing and cycling circuit forming part of the control circuit block diagram in FIG. 3.
Figure 3B:
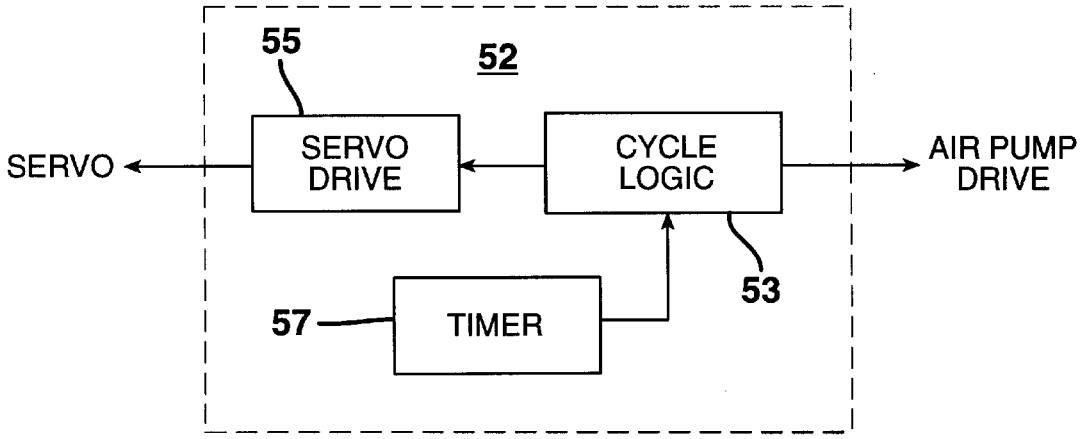

Refer now to FIGS. 3, 3*a* and 3*b* which are simplified block diagrams of the relationships of the major functional circuitry that are contained in the control circuits 50.

In FIG.3, the control/alarm panel 5 is connected input to the on/off switching circuit 64 which responds to the on/off power switch on the panel 5. When the power switch is turned on, the on/off switching circuit 64 connects the do input power to the voltage regulator 66 which supplies all system power. DC input power is usually available from only the battery 40, which is always connected. However, if an alternative dc input power source 24 is plugged in, the battery 40 will automatically be disconnected by the on/off switching circuit 64, and only the alternate dc power source is connected to the voltage regulator 66. This precaution avoids any likelihood of damaging the battery by an input over voltage.

The on/off switching circuit 64 also includes provision for automatically switching system power off if it receives command signals indicating failures such as system over temperature or undervoltages from the failure sense circuit 60. The failure sense circuit 60, on sensing the impending failures, first activates the alarms circuit 62, generating signals to activate visual and audio alarms on the control/alarm panel 5, then after a short period, commands the on/off switching circuit 64 to shut down the system.

These are safety provisions included to protect the user who may be a elderly patient, as well as to avoid damage to the system.

A battery charger circuit 58 is included to accept power from a charging source 26 and to output controlled, constant current to recharge the battery 40. This is done to ensure that the battery is properly and safely recharged.

The remaining control circuits are concerned only with activating and controlling the bladder arrays and supporting mechanisms. These circuits perform the functions of timing and control 52, air pressure regulation 54 and air pump drive 56 for the air pump motor 32. The air pump drive 56 turns power on or off to the air pump 32 motor and controls the pump motor in response to signals from the pressure regulator 54 and the timing and cycling 52 circuits. The pressure regulator 54 senses line air pressure at the pressure switch 34 and feeds back pressure adjusting signals to the air pump drive 56 as required by pre-determined or programed settings in the microprocessor.

The timing and cycling circuit 52 is the source for all signals controlling operation of the air pump, pressure regulation, the servo, the shuttle valve and thereby the bladder arrays. FIGS. 3*a* and 3*b* briefly depict alternate configurations for the timing and cycling circuit 52. The preferred configuration is shown in FIG. 3*a*. This, in greatly simplified form, shows a microprocessor 51 and a servo drive 55. The servo drive 55 is a well known circuit that accepts signals from the microprocessor 51 and power from the system power supply to activate the servo 38 for changing shuttle valve 36 settings.

The microprocessor 51 is pre-programed to output command signals that will result in the air bladder arrays being sequentially inflated or deflated for any time periods and being cycled at any selected frequency. Provision is made for re-programming the microprocessor through an external connector 21 whenever desired. Such microprocessors are quite small in size, are reliable, use little power and are inexpensive.

FIG. 3*b* shows a cycle logic circuit block 53 and an oscillator timer circuit 57 as an alternate way of controlling the servo drive 55 and the air pump drive. The cycle logic circuit 53 is composed of gates, counters, switches and amplifiers plus supporting components, connected and arranged in a circuit to output a fixed set of signals to the servo drive and air pump drive. This fixed set of signals can produce only one given mode of bladder array operation, with possible adjustment to cycle timing by means of a potentiometer.

For many system applications, the cycle logic approach to the timing and cycling function is adequate and relatively straightforward. Its drawbacks include in addition to lack of versatility in timing and cycling control, a higher power consumption than the microprocessor approach and a probably lower reliability due to the increased component count. Its advantages may include lower overall cost and simplicity.

Figure 4A:
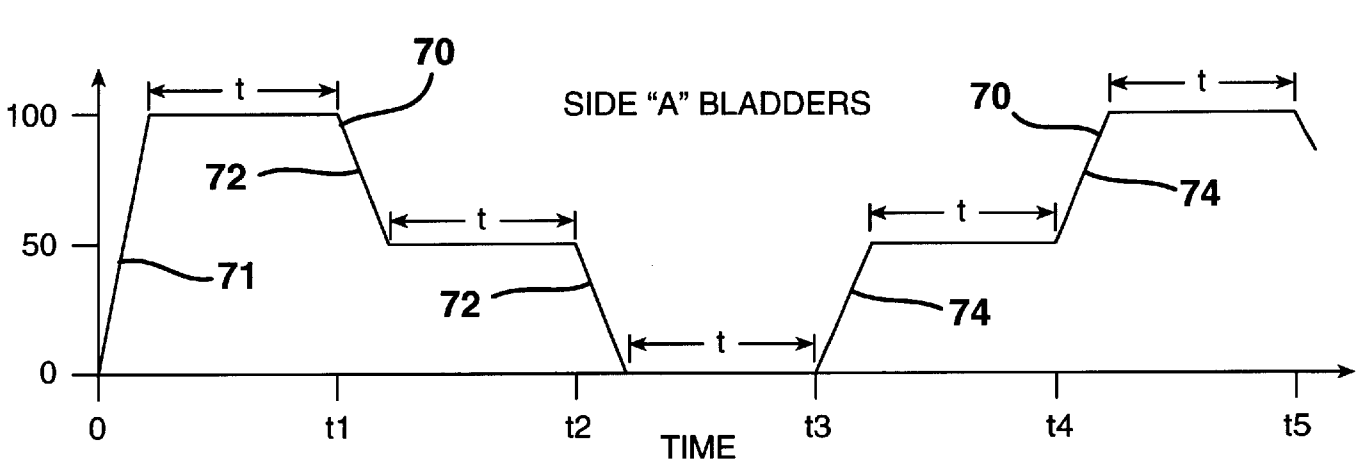
FIGS. 4*a* and 4*b* illustrate a typical bladder inflation cycle waveform for two bladder arrays A and B, and are useful in understanding operation of the invention system.
Figure 4B:
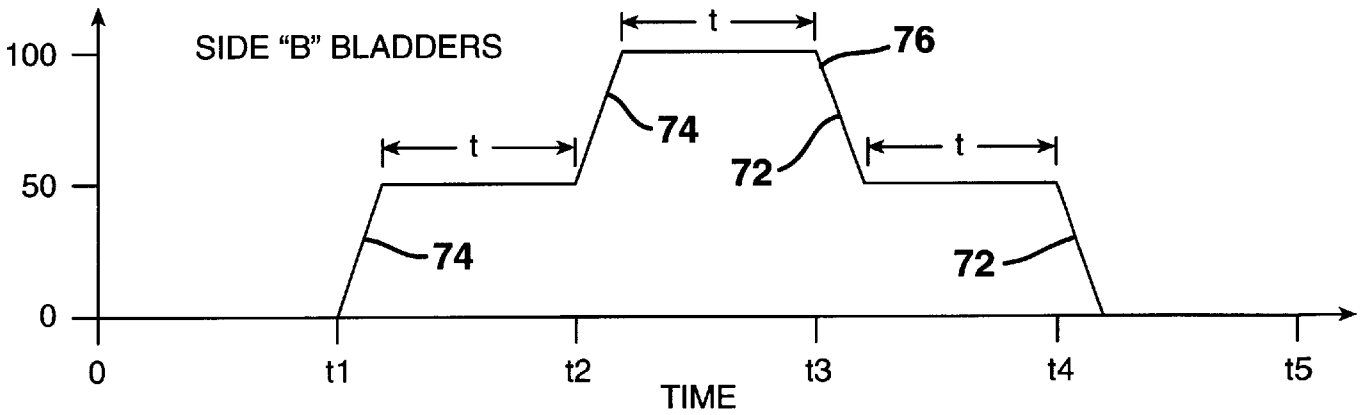

Having described the invention system shown in FIG. 2, FIGS. 4*a*, 4*b*, 5*a*, 5*b*, 5*c* and 5*d* are offered as being helpful in understanding the operation of a two bladder array system per FIG. 2 which is now discussed. Typical cycle operation of A array bladder waveforms 70 are shown in FIG. 4*a* while B array bladder waveforms 76 are shown in FIG. 4*b*.

When the system is turned on (marked zero on the time scale of FIGS. 4*a*, 4*b*), the air pump 32 begins compressing air and filling 71 the A array bladders until the bladders reach a preset pressure limit corresponding to a given level of inflation, in this case 100%. The pump 32 is then turned off by signals from the pressure switch 34 and control circuits 50, and held off until time t2 when two intervals have passed.

After one interval at time t1, the servo 38 motor controlling the shuttle valve 36 is commanded to vent 72 the high pressure air from the A array bladders 70 into the B array bladders 76, which fill 74 until pressure in both arrays are equalized.

At time t2, the servo 38 motor is commanded to cause the shuttle valve 36 to vent 72 the A array bladders to the atmosphere, completely deflating the bladders. At the same time side B array bladders are sealed off from the A array, and the air pump 32 is restarted and fills 74 the B array bladders until a preset pressure limit is reached. The air pump 32 is then turned off until time t4.

At time t3, the servo 38 motor controlling the shuttle valve 36 is commanded to vent 72 the high pressure air from the B array bladders 76 into the A array bladders 70, which fill 74 until pressure in both arrays are equalized. Note that this is the same action as at time t1 except that the venting and filling are in reverse to that at time t1.

At time t4, the servo 3,3 motor is commanded to cause the shuttle valve 36 to vent 72 the B array bladders 76 to the atmosphere, completely deflating the bladders. At the same time side A array bladders are sealed off from the B array, and the air pump 32 is restarted and fills 74 the A array bladders 70 until a preset pressure limit is reached. The air pump 32 is then turned off until time t6.

Looking at FIGS. 4*a* and 4*b*, it can be seen that one full cycle for the operation of both bladder arrays takes place from time t1 to time t5, or in four time intervals. Each time interval t1–t2 etc., may be any time that allows for bladder filling or venting and some time at a fixed inflation pressure. For the system application shown in FIG.1, where the cushioned system is intended for use in a wheelchair or for a truck driver, a reasonable time interval between changes in the cushion shape and thus pressure points, is approximately 4 minutes. Input from medical doctors and surgeons suggest that soft tissue begins a process of cellular destruction after about 20 minutes deprivation of fresh blood supply. When set at 4 minute intervals between changes in bladder inflation, one system cycle would take about 16 minutes, which is quite acceptable.

Figure 5A:
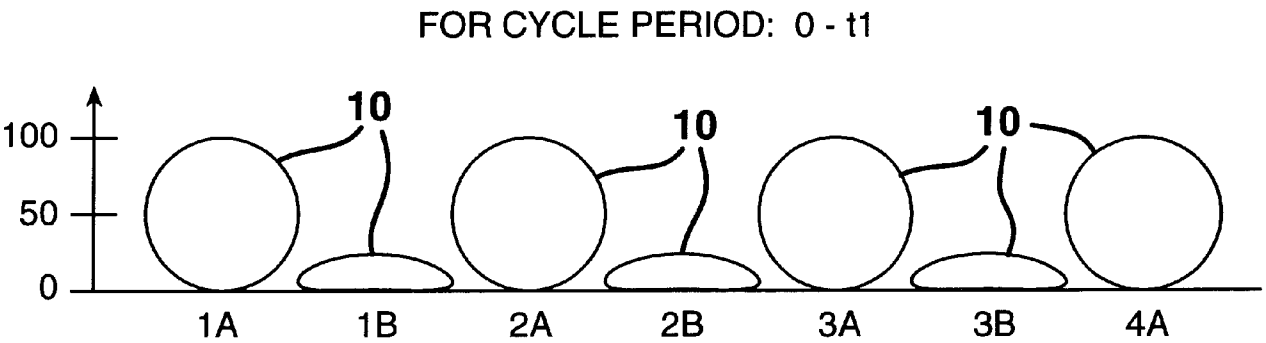
FIGS. 5*a*, 5*b*, 5*c*, and 5*d* illustrate bladder inflation for cycle time periods referenced in FIGS. 4*a*, 4*b* and are useful in visualizing the bladder inflation cycle.
Figure 5B:
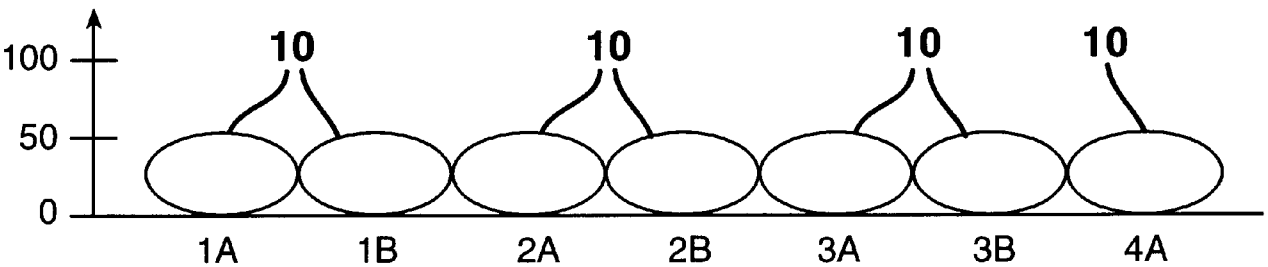
Figure 5C:
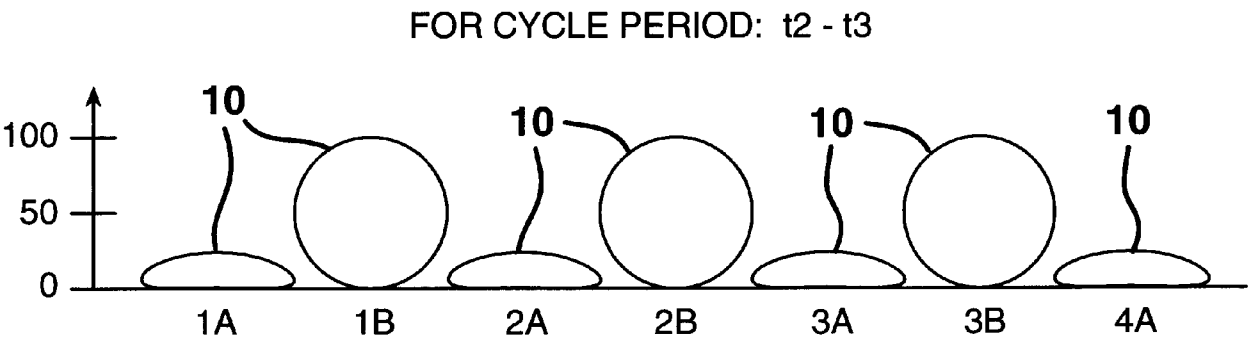
Figure 5D:
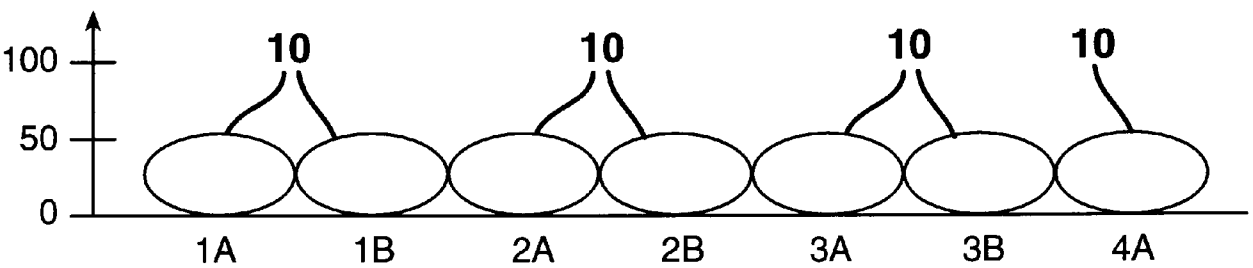

FIGS. 5*a*, 5*b*, 5*c* an 5*d* illustrate the air pressure inflation status of seven of the bladders 10 for each time interval of a cycle, corresponding to the bladder inflation waveforms shown in FIGS. 4*a* and 4*b*. Four of the bladders are in array A and are labeled 1A through 4A. The remaining bladders are in array B and are labeled 1B through 3B. For convenience, only seven bladders are shown. The exaggerated bladder 10 shapes show clearly the effects of the previously described operation events during one full cycle. During cycle period 0–t1, only the A array bladders are fully inflated, leaving a low pressure space between each inflated bladder. During cycle period t1–t2, all the bladders are at the same pressure inflation level, which in this case is 50%. During the next cycle period t2–t3, it is now the turn of the B array bladders to be fully inflated while the A array bladders lie in between, deflated. Thus the applied maximum pressure support points are shifted from the A array bladders locations to the B array bladders. In the final cycle period t3–t4, both A and B array bladders are at equal inflation level.

From the foregoing, it can be seen that for a two array system such as described herein, the time between change of location of applied pressure to a cushion is one interval of approximately four minutes.

If more than two bladder arrays are utilized in the system, depending on the selected generated inflation waveforms, the time between changes of applied pressure location could be one interval or more. Of course, the interval time period may be any time selected to suit the application of the system. All the above selected waveforms, interaction between arrays and interval timing are programed into the microprocessor which is contained in the system control/activation module 20.

In the foregoing described system, the following areas are variable. These are: the bladder arrays and manifolds, the timing/cycling control circuits, and the rigid support member. As noted earlier, two or more arrays, each having a multiplicity of bladders may be employed. The number of air manifolds would necessarily match the number of bladder arrays. The rigid support member may be any convenient shape capable of supporting the bladder arrays and sized to accommodate a control/activation module. The timing/cycling control circuits may utilize a re-programable microprocessor or use control logic and timer circuits having a single control mode for operation of the arrays.

These variations are embedded in the invention system, making the system very versatile in its possible applications.

A summary of the features of a wheelchair cushion incorporating the invention system is as follows:

1. The cushion/system is completely portable, self-contained and operates without external power for at least 16 hours or more, dependent only on the amp-hour capacity of the rechargeable battery cells installed in the power pack.

2. The cushion/system addresses the problem of preventing formation of pressure sores (decubitus ulcers) by providing a constant but gentle changing of pressure point distribution approximately every four minutes, thus ensuring a fresh supply of blood to soft tissue under setting pressure.

3. Since many users are paraplegics and have no feeling in the lower extremities to warn them by discomfort and signal them to move, the system includes audio and visual alarms located on a panel attached to a wheelchair arm, that will warn of failures such as Low battery voltage, a severe air-leak in the bladder system or errant cycle timing.

4. The system operating cycle can be programed to suit particular individual needs.

Another system application is addressed to a cushion for supporting long-haul truck drivers. This application could be mostly powered by plugging into a cigarette lighter receptacle, with a battery kept in reserve. The system may use multiple bladder arrays and extend up the back of a seat to massage and alternate the pressure points on the users back as well as buttocks and thigh areas under seating pressure.

A further system application may be a seat-only cushion for office workers, and could be powered by an adjacent outlet. Such a cushion system would greatly reduce fatigue brought on by sitting discomfort over a working day.

Yet another envisaged application is a concept for use by animal care providers, to help prevent pressure sores in old animals who cannot easily move around, or who are sick.

Finally, there are also applications of the system to a hospital use for patients who are must remain lying in one position. The bladder arrays in this case may be made large or small in size to fit up against the body parts to be stimulated.

The system electrical design is efficient, having overall power losses of 20 percent or less, so that given the low input power demand associated with largely solid-state circuitry, the power dissipation is minimal. This is an important consideration and advantage for most applications that are in close contact with humans. All control and activating components are small and light weight, allowing them to be packaged in a relatively small module. Safety considerations are addressed by the use of insulation and failure sensors that warn the user of system problems and automatically shut down the system in the case of over temperature and other failures.

System cost for a wheelchair cushion is relatively lower than known presently available cushion systems incorporating a variable pressure point capability.

From the above description, it is clear that the preferred embodiment of the variable pressure point, body support system achieves the objects of the present invention. Alternative embodiments and various modifications may be apparent to those skilled in the art. These alternatives and modifications are considered to be within the spirit and scope of the present invention.

Having described the invention, what is claimed is:

1. A system for generating constantly changing pressure points for a cushion supporting a person or animal, said system, in combination comprising;

(a) a rigid support member;

(b) a first bladder array comprising a multiplicity of inflatable bladders which are arranged in rows and supported by said support member;

(c) a second bladder array comprising a multiplicity of inflatable bladders which are arranged with each bladder located alternately between the rows of said first bladder array and supported by said support member;

(d) a multiplicity of cloth covers; a cover separately covering each bladder in said first bladder array and in said second bladder array, said covers being fastened to said support member and sized to contain a fully inflated bladder under each cover;

(e) a first air manifold for supplying said first bladder array, all bladders in said first bladder array being connected in parallel to said first air manifold;

(f) a second air manifold for supplying said second bladder array, all bladders in said second bladder array being connected in parallel to said second air manifold;

(g) air pump means for supplying regulated pressured air to said first air manifold and said second air manifold;

(h) means for switching pressured air input from said air pump means to said first air manifold or to said second air manifold on command, for air inflation of said bladders;

(i) means for bleeding pressured air from said first air manifold and said second air manifold on command;

(j) a rechargeable battery power supply, said battery power supply being sized to supply at least 16 hours system operating time before need to be recharged;

(k) first means for system control, said first means including control circuits comprising:

a power on/off switching circuit;

a voltage regulator circuit which is enabled by said power on/off switching circuit;

second means for timing and cycling control, said second means including a re-programable microprocessor that is programed for controlling the inflation cycling of the bladders in said first bladder array and said second bladder array in any pre-determined sequence and time intervals to vary the pressure and points of support applied to a supported body through a cushion;

third means for system failure sensing, said third means including circuits that sense for system over-temperature or over/undervoltage conditions and command a system shut down if any such conditions are found;

an alarm generating circuit connected to said third means and producing alarm activation signals when required;

a pressure regulator circuit connected to said air pump means and to said second means;

an air pump drive circuit connected to said second means and to said pressure regulator circuit;

a servo drive circuit connected to said second means; and a battery charging circuit for recharging said battery power supply from an external power source; and (l) means for remotely energizing the system and announcing system alarms to a user.

2. The system according to claim 1, wherein said support member is made of rigid, foamed plastic material and includes an internal cavity sized to enclose a system control and activation module with clearance, said system control and activation module containing all system controls, air pump means and a battery power supply, providing component protection and enhancing user safety.

3. The system according to claim 1, wherein said bladders are made of a soft elastic material for applying support pressure to a cushioned surface when said bladders are inflated.

4. The system according to claim 1, wherein said air pump means for supplying regulated pressured air includes an electrically driven air pump and a pressure switch circuit, said pressure switch circuit being connected to and sensing the pressured air output of said air pump; said pressure switch circuit monitoring the pump output air pressure and outputting signals to said first means for system control to adjust the operation of said air pump to bring its output air pressure within tolerance of a reference setting; said pressure switch circuit including provision for monitoring air inflation pressure in the bladder arrays and responding when limits are reached by generating signals resulting in shut down of said air pump.

5. The system according to claim 1, wherein said means for switching pressured air input from said air pump means includes a mechanically driven shuttle valve and a servo-motor that is mechanically connected to said shuttle valve; said servo-motor being activated when required by said first means for system control and causing said shuttle valve to switch said pressured air input to said first air manifold or to said second air manifold.

6. The system according to claim 1, wherein said means for remotely energizing the system and announcing system alarms, includes a panel which is connected electrically to said first means for system control; said panel including a power on/off switch, an audio alarm and at least one visual alarm lamp to alert a user of an impending occurrence of system failure.

7. A system for generating constantly changing pressure points for cushions supporting a person or animal, said system in combination comprising:

a first section including a rigid support member, said support member having an internal cavity sized to enclose a system control and activation module with clearance;

a second section including a plurality of bladder arrays, said bladder arrays each comprising a plurality of air inflatable bladders, said second section being supported by said support member, said bladder arrays being disposed so that individual inflatable bladders in any one array are located alternately, side by side with individual inflatable bladders in other arrays, permitting variation in the location of fully inflated bladders and applied pressure areas, said inflatable bladders each being separately covered by a cloth cover and thereby fastened to said support member;

a third section including a plurality of air manifolds for supplying pressured air to said bladder arrays, the quantity of manifolds corresponding to the quantity of bladder arrays;

a fourth section including a system control and activation module containing and comprising: air pump means for supplying regulated pressured air to said plurality of air manifolds; means for switching pressured air input from said air pump means to any selected bladder arrays via air manifolds, on command for air inflation of said bladders; means for bleeding pressured air from any selected bladder arrays via air manifolds, on command; a rechargeable battery power supply, said battery power supply being sized to supply at least 16 hours system operating time before need to be recharged; a first means for system control, said first means including control circuits comprising: a power on/off switching circuit; a voltage regulator circuit which is enabled by said power on/off switching circuit; a re-programable microprocessor that is programed for controlling the inflation cycling of the bladders in each bladder array in any pre-determined sequence and time intervals to vary the pressure and points of support applied to a supported body through a cushion; second means for system failure sensing, said second means including circuits that sense for system over-temperature or over/undervoltage conditions and command a system shut down if any such conditions are found; an alarm generating circuit connected to said second means and producing alarm activation signals when required; a pressure regulator circuit connected to said air pump means and to said microprocessor; an air pump drive circuit connected to said microprocessor and to said pressure regulator circuit; a servo drive circuit connected to said microprocessor; and a battery charging circuit for recharging said battery power supply from an external power source; and a remote control and alarm panel for energizing the system and announcing alarms to a user.

8. The system according to claim 7, wherein said rigid support member is made of a rigid foamed plastic material, said support member being shaped to fit under a cushion that is shaped to fit and support a given body portion.

9. The system according to claim 7, wherein said bladders are made of a soft elastic material for applying support pressure to a cushioned surface when said bladders are inflated.

10. The system according to claim 7, wherein said air pump means for supplying regulated pressured air includes an electrically driven air pump and a pressure switch circuit, said pressure switch circuit being connected to, and sensing the pressured air from the output of said air pump; said pressure switch circuit monitoring the pump output air pressure and outputting signals to said first means for system control to adjust the operation of said air pump to bring its output air pressure within tolerance of a reference setting; said pressure switch circuit including provision for monitoring air inflation pressure in the bladder arrays and responding when limits are reached by generating signals resulting in shut down of said air pump.

11. The system according to claim 7, wherein said means for switching pressured air input from said air pump means includes a plurality of mechanically driven shuttle valves and servo-motors that are mechanically connected to said shuttle valves; said servo-motors being activated when required by said first means for system control and causing said shuttle valves to switch said pressured air input between said air manifolds to inflate said bladders.

12. The system according to claim 7, wherein said remote control and alarm panel is connected electrically to said first means for system control; said panel including a power on/off switch, an audio alarm and at least one visual alarm lamp to alert a user of an impending occurrence of system failure.

* * * * *